United States Patent [19]

Mead et al.

[11] 4,018,693

[45] Apr. 19, 1977

[54] TRANSFORMER OILS

[75] Inventors: Theodore C. Mead, Port Arthur; William B. Ashton, Nederland, both of Tex.

[73] Assignee: Texaco Inc., New York, N.Y.

[22] Filed: Oct. 21, 1974

[21] Appl. No.: 516,556

[52] U.S. Cl. ..... 252/64; 252/65; 252/63; 252/52 R; 174/17 LF; 336/94

[51] Int. Cl.[2] ..... H01B 3/22

[58] Field of Search ..... 252/64, 63, 52, 56, 252/63.7, 66; 174/110, 17 LF; 336/94

[56] References Cited

UNITED STATES PATENTS

| | | | |
|---|---|---|---|
| 2,019,336 | 10/1935 | Clark | 252/64 |
| 2,922,938 | 1/1960 | Petley | 252/63.7 |

*Primary Examiner*—John D. Welsh

*Attorney, Agent, or Firm*—Thomas H. Whaley; Carl G. Ries; Kenneth R. Priem

[57] ABSTRACT

The transformer oils of improved resistivity are prepared by adding an effective quantity of a carbonyl containing compound particularly an aldehyde or ketone to a conventional transformer oil.

14 Claims, No Drawings

TRANSFORMER OILS

BACKGROUND OF THE INVENTION

1. Field of the Invention

This invention pertains to the field of transformer oils.

2. Description of the Prior Art

Transformer oils must maintain a high resistivity (resistance to electrical charge). Any method of increasing the resistivity of transformer oils is welcome in the art particularly since, at present, the oils having highest resistivity are acid treated oils. There are two general types of transformer oils: acid treated oils and hydrogenated oils. Acid treated oils are generally superior with regard to the properties of the finished product. The acid treating process, however, suffers from severe disadvantages including high maintenance costs, difficulty of sludge disposal, and ecological drawbacks.

It is an object of our invention to provide a transformer oil of improved resistivity regardless of whether the base oil is acid treated or hydrogenated.

SUMMARY OF THE INVENTION

The invention is a transformer oil containing an effective amount of a carbonyl containing compound such that the resulting oil has increased resistivity.

DESCRIPTION OF THE PREFERRED EMBODIMENTS

Transformer oils are generally light naphthene oils although dewaxed paraffin oils may also be used. An oil of approximately 50 SUS viscosity at 100° F is acceptable but other oils between 40 SUS viscosity and 200 SUS viscosity at 100° F are also acceptable for the oil of our invention. The base oil stock is generally processed in one of two ways. Acid treated oils are subjected to a sequence of treatment involving as the principal step, treatment with sulfuric acid. Hydrogenated oils are treated in a sequence which involves as the principal step, hydrogenation.

Although it is not absolutely necessary to produce oils acceptable for our invention, it is preferred that the base oil should be caustic washed before acid treating or hydrogenation. Caustic washing is an accepted practice in industry, and the process is well known. Therefore, the following discussion of suggested conditions is not to be considered limiting to our invention.

Oil is washed with 15° Be′ sodium hydroxide solution at a dosage of 10 ml per liter of oil at about 135° F with agitation. It is then washed with water until neutral and blown dry with nitrogen at about 160° F. Although the preceding conditions are preferable, broader acceptable operating limits are suggested as follows: 10° Be caustic concentration and 50 to 200 percent of the above indicated caustic dosage. Also, temperatures may vary 50° F from those indicated above.

Acid treated oils are usually agitated with 98 percent sulfuric acid at a preferred initial dosage of 4 pounds per barrel. The oil is then separated from this acid and agitated with an additional charge of sulfuric acid at a preferred dosage of about 10 pounds per barrel resulting in a total acid dosage of about 14 pounds per barrel. It is preferred at this point that 1 percent water be added to promote coagulation of acid sludge and to aid in the separation of phases. The acid is then separated from the oil by known procedures and the oil is washed with one percent 15° Be soda ash and nitrogen blown at about 140° F. The oil is then water washed until it is neutral and blown dry with nitrogen at about 160° F.

The acid treating process described above is with preferred conditions and reagents. Operable ranges which are acceptable to our invention, however, are as follows: The temperature may vary 10° F from those indicated above and the total acid dosage may vary between 5 pounds per barrel and 200 pounds per barrel.

The acid used for treating may be 80 to 90 percent sulfuric acid or fuming sulfuric acid. Corrosion problems occur as the concentration is reduced, but in theory the process of sulfuric acid treatment is not concentration limited. Hydroflouric acid is also acceptable as the reagent in the acid treating step.

Hydrogenation of oil for use in transformer oil is preferably carried out at about 600° F at a space velocity of about 1.0 volume of oil per volume of catalyst per hour (v/v-hr), at about 300 psi hydrogen pressure, and at a hydrogen dosage of about 470 SCFB of hydrogen. Acceptable hydrogenation conditions, however, include a temperature range of between 350° and 750° F at pressures ranging between 250 and 1800 psig, and a space velocity between 0.25 and 3 v/v-hr in the presence of hydrogen introduced at a rate of from 100 to 5,000 SCFB. The conditions should be selected within the above ranges so that there is substantially no conversion to materials boiling below the lube oil range.

Suitable hydrogenation catalysts comprise metals or compounds of metals of Group VI and Group VIII of the Periodic Table. Non-limiting examples of such components are Chromium, Molybdenum, Tungsten, Iron, Cobalt and Nickel and compounds thereof or their mixtures. Generally, these components are supported on a base comprising a refractory inorganic oxide material such as alumina, silica, magnesia, zirconia, titania and the like, and mixtures thereof. The catalyst may be used in the form of a slurry or a fixed bed. The flow may be either upward or downward. The flow of hydrogen may be counter-current to the flow of oil if desired. Particularly suitable catalysts are those containing 10 weight percent cobalt or nickel or 5 to 30 weight percent molybdenum or tungsten. Preferred catalysts are those containing about 6 weight percent nickel and 20 weight percent tungsten or about 2 to 4 weight percent cobalt or nickel and 5 to 10 weight percent molybdenum supported on alumina. Although the catalyst may be subjected to chemical change in the reaction zone due to the presence of sulfur and hydrogen therein, catalyst is ordinarily in the form of the oxide or sulfide when first brought into contact with the charge stock.

If desired, the acid treated or hydrogenated oil is then percolated through fresh or reburned equilibrium porocel clay, although other types such as Attapulgus clay, for example, would be acceptable. Acceptable operating conditions for clay percolation include:

Rate about 0.1 to 1.0 (bbl oil per ton clay)/ hr., (BPT/hr)

Throughput about 10 to 250 BPT

Preferred range of conditions for clay percolation are:

Rate about 1.3 – 0.3 BPT/hr.

Throughput about 50 – 200 BPT

The conditions used for the examples which follow, were typically 0.50 BPT/hr rate and 100 BPT throughput. The carbonyl compounds which are suitable for our invention include but are not limited to aldehydes, ketones, esters, $\alpha,\beta$ unsaturated carbonyl compounds, amides, lactams, and lactoms, and lactones. Aldehydes and/or ketones are the preferred carbonyl compounds for use as transformer oil additives in our invention. For example, dialkyl ketones, alkyl aldehydes, alkylaryl ketones, aryl aldehydes, alkyl cycloalkyl ketones, dicycloalkyl ketones and diaryl ketones are useful. To further illustrate compounds useful as transformer oil additives in our invention the following generic structures are shown representing carbonyl compounds useful in our invention.

| Structure | Preferred Range | Operable Range |
|---|---|---|
| 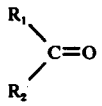 | $R_1 = C_1 - C_4$ | $R_1 = C_1 - C_{30}$ |
| | $R_2 = C_1 - C_4$ phenyl or substituted phenyl | $R_2 = C_1 - C_{30}$ |
| $R_1$ CHO | $R_1 = C_1 - C_4$ phenyl or substituted phenyl | $R_1 = C_1 - C_{30}$ |
| 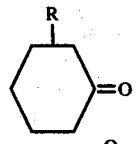 | $R_1 = C_1 - C_4$ | $R = C_1 - C_{30}$ |
| 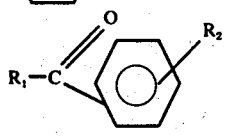 | $R_1 = C_1 - C_4$ | $C_1 - C_{30}$ |
| | $R_2 = C_1 - C_4$ | $C_1 - C_{30}$ |

In the above cases, the R groups may be either saturated or olefinic.

The carbonyl compound should blend intimately with the transformer oil at concentrations ranging from 25 to 500 ppm. preferably at concentrations ranging from 25 to 100 ppm. Concentrations outside these ranges may prove operable in some cases and there is no intention to limit the scope of our invention by specifying a concentration.

EXPERIMENTAL

The following demonstrates the effect on resistivity of blending additives into acid heated and hydrogenated transformer oils.

Acid Treated Oils

A transformer oil was acid treated after being caustic washed as follows: The oil was agitated with 98% sulfuric acid at four pounds per barrel. The oil was then separated from the acid. The oil was then further treated with an additional charge of sulfuric acid at a dosage of 10 pounds per barrel. At this point, one percent water was added to promote coagulation. The acid was separated from the oil and the oil was washed with one percent 15° Be soda ash and nitrogen blow at about 160° F. The oil was then percolated through porocel clay at about 0.50 BPT/hr. and 100 BPT throughput. This oil having ASTM D-1169 resistivity of $44 \times 10^{12}$ ohm-cm was blended with 50 and 500 parts per million of acetone, methyl ethyl ketones, crotonaldehyde, benzaldehyde, o-tolualdehyde, cinnamaldehyde and undecyclic aldehyde. Each blend was submitted for duplicate determination of resistivity at 100° C .

| Concentration ppm / Additive | Resistivity, ohm-cm $\times 10^{12}$ at 100° C | |
|---|---|---|
| | 500 | 50 |
| None | 44 | |
| methyl ethyl ketone | 70 | 78 |
| acetone | 53 | 64 |
| benzaldehyde | — | 33 |
| o-tolualdehyde | 33 | 70 |
| cyclohexanone | 31 | 53 |
| crotonaldehyde | 31 | 51 |
| cinnamaldehyde | 29 | 40 |
| undecylic aldehyde | 18 | 38 |

[1] Resistivity at 25° C is also determined in D-1169 in all cases, including the base oil, a resistivity of $881 \times 10^{12}$ ohm-cm was obtained.

Hydrogenated Oil

A transformer oil was first caustic washed and then hydrogenated as follows. The oil was hydrogenated at about 600° F at a space velocity of 1.0 volume of oil per volume of catalyst per hour. At about 300 psi hydrogen pressure and at a hydrogen dosage of about 470 SCFB of hydrogen. After hydrogenation, the oil was percolated through Porocel clay at about 0.50 BPT/hr. rate and 100 BPT throughput. This oil having ASTM 10 1169 resistivity of $3.5 \times 10^{12}$ ohm-cm was blended with 50 and 500 parts per million of methyl ethyl ketone, acetone, benzaldehyde, o-tolualdehyde, cyclohexanone, crotonaldehyde, cinnamaldehyde and undecylic aldehyde. Each blend was submitted for duplicate determination of resistivity at 100° C.

| Concentration, ppm / Additive | Resistivity, ohm-cm $\times 10^{12}$ at 100° C | |
|---|---|---|
| | 500 ppm | 50 ppm |
| None | 3.5 | |
| methyl ethyl ketone | 9.1 | 9.73 |
| acetone | 7.7 | 8.75 |
| benzaldehyde | 5.0 | 6.12 |
| o-tolualdehyde | 5.99 | 9.1 |
| cyclohexanone | 5.99 | 7.7 |
| crotonaldehyde | 5.98 | 7.6 |
| cinnamaldehyde | 5.81 | 6.69 |
| undecylic aldehyde | 4.94 | 6.51 |

We claim:

1. A transformer oil comprising:
   a. a naphthene or paraffin base oil ranging in viscosity about 40 to 200 SUS at 100° F and
   b. a carbonyl compound chosen from the group consisting of aldehydes and ketones.
2. An oil as in claim 1 wherein the carbonyl compound is chosen from the group consisting of dialkyl ketones, aryl aldehydes, alkyl cycloalkyl ketones, dicyclo alkyl ketones and diaryl ketones.
3. An oil as in claim 2 wherein the carbonyl compound is methyl ethyl ketone.
4. An oil as in claim 2 wherein the carbonyl compound is acetone.
5. An oil as in claim 2 wherein the carbonyl compound is o-tolualdehyde.
6. An oil as in claim 2 wherein the carbonyl compound is cyclohexanone.
7. An oil as in claim 2 wherein the carbonyl compound is crotonaldehyde.
8. A transformer oil comprising:
   a. a hydrogenated naphthene or paraffin base oil ranging in viscosity from about 40 to 200 SUS at 100° F and b. a carbonyl compound selected from the group consisting of aldehydes and ketones.

9. An oil as in claim 8 wherein the carbonyl compound is chosen from the group consisting of dialkyl ketones, aryl aldehydes, alkyl cycloalkyl ketones, dicycloalkyl ketones and diaryl ketones.

10. An oil as in claim 9 wherein the carbonyl compound is methyl ethyl ketone.

11. An oil as in claim 9 wherein the carbonyl compound is acetone.

12. An oil as in claim 9 wherein the carbonyl compound is o-tolualdehyde.

13. An oil as in claim 9 wherein the carbonyl compound is cyclohexanone.

14. An oil as in claim 9 wherein the carbonyl compound is crotonaldehyde.

* * * * *